United States Patent [19]

Martinez

[11] 4,106,230

[45] Aug. 15, 1978

[54] PHOTO ALBUM

[75] Inventor: Eugene E. Martinez, Woodbine Rd., Irvington-On-Hudson, N.Y. 10533

[73] Assignee: Robert H Reikel, Irvington-On-Hudson, N.Y.

[21] Appl. No.: 767,503

[22] Filed: Feb. 10, 1977

[51] Int. Cl.[2] ..... G09F 1/10

[52] U.S. Cl. ..... 40/158 R; 40/391

[58] Field of Search ..... 40/158 R, 152, 104.03, 40/125 A

[56] References Cited

U.S. PATENT DOCUMENTS

| | | | |
|---|---|---|---|
| 2,096,559 | 10/1937 | Riley | 40/158 R |
| 2,102,690 | 12/1937 | Fischer | 40/125 A |
| 2,304,158 | 12/1942 | Flood | 40/104.03 |
| 2,610,421 | 9/1952 | Horn | 40/158 R |
| 2,755,576 | 7/1956 | Golden | 40/125 A |
| 3,024,553 | 3/1962 | Rowley | 40/158 R |
| 3,503,835 | 3/1970 | Hermann | 40/158 R |
| 3,740,879 | 6/1973 | Patterson | 40/158 R |
| 3,847,325 | 11/1974 | Nasalski et al. | 40/158 R |

FOREIGN PATENT DOCUMENTS

| | | | |
|---|---|---|---|
| 1,370,061 | 10/1974 | United Kingdom | 40/158 R |

*Primary Examiner*—Louis G. Mancene
*Assistant Examiner*—John J. Wilson
*Attorney, Agent, or Firm*—J. B. Felshin

[57] ABSTRACT

This album comprises a backboard. Attached to the backboard are a plurality of transverse, parallel strips each coated at its underside with adhesive. Said strips are each adhered to the top face of the backboard, each strip having a section or portion inclined away from the top face of the backboard. Adhered to each of said inclined portions of said strips, is a bent back section or portion of a transverse release ribbon. Said ribbons have extending tab portions which may be grasped by fingers of the user to pull the release ribbon off and away from the strip to uncover the adhesive coated inclined section or portion of the strip. A photographic snap shot may be adhered at its lower end to said uncovered portion of the strip. The snapshots can each be folded 180° from a position exposing the picture of the photo to a position in which the picture is hidden at the underside of the photo. The extending tab portion of each release ribbon overlies the strip next adjacent thereto in a direction toward the upper end of the backboard.

20 Claims, 11 Drawing Figures

PHOTO ALBUM

This invention relates to photographic snapshot albums. An object of this invention is to provide an album of the character described comprising a backing member or backboard, adhesive coated strips each adhered at one coated area of each strip to said backing member, a release ribbon having one portion coated with release material and adhered to another adhesive coated area of each of said strips, and provided with a pull tab adapted to be grasped to permit pulling off the release ribbon while permitting the strip to remain adhered to the backing member and to expose said another coated area of the strip, so that a photo snapshot can be adhered to said exposed another area.

Another object of this invention is to provide an album of the character described in which the adhesive strips are parallel and each adhesive strip has one portion adhered to the backing member, and an adjacent portion swingable away from the backing member, and in which each ribbon has one portion adhered to said swing away portion of said strip, and another portion extending beyond said swing away portion of said strip and comprising a pull tab to permit the ribbon to be pulled off said strip to expose the adhesive surface of said swing away portion of said strip and allow one end portion of a photo snapshot to be adhered to said exposed adhesive surface of said strip.

Still another object of this invention is to provide an album of the character described in which the pull tab of one release ribbon overlaps the adjacent strip in the direction toward the upper end of the backing member.

Yet another object of this invention is to provide an album of the character described in which the backboard is covered partially by adhesive coated strips and release ribbons attached to said strips, an upper portion of said backboard being blank so that the photo snapshot which is attached to the uppermost strip on the backboard will overlie said blank portion.

A further object of this invention is to provide an album of the character described in which the attached photo snap-shots can all be folded upwardly, so that the pictures on the snapshots face forwardly, and in which said photo snapshots can be all folded downwardly so that the pictures on the snapshots are hidden.

A still further object of this invention is to provide a durable album of the character described which shall be relatively inexpensive to manufacture, easy to manipulate, and which shall be practical and efficient to a high degree in use.

Other objects of this invention will in part be obvious and in part hereinafter pointed out.

The invention accordingly consists in the features of construction, combinations of elements, and arrangement of parts which will be exemplified in the construction hereinafter described and of which the scope of invention will be indicated in the following claims.

Figure 1:
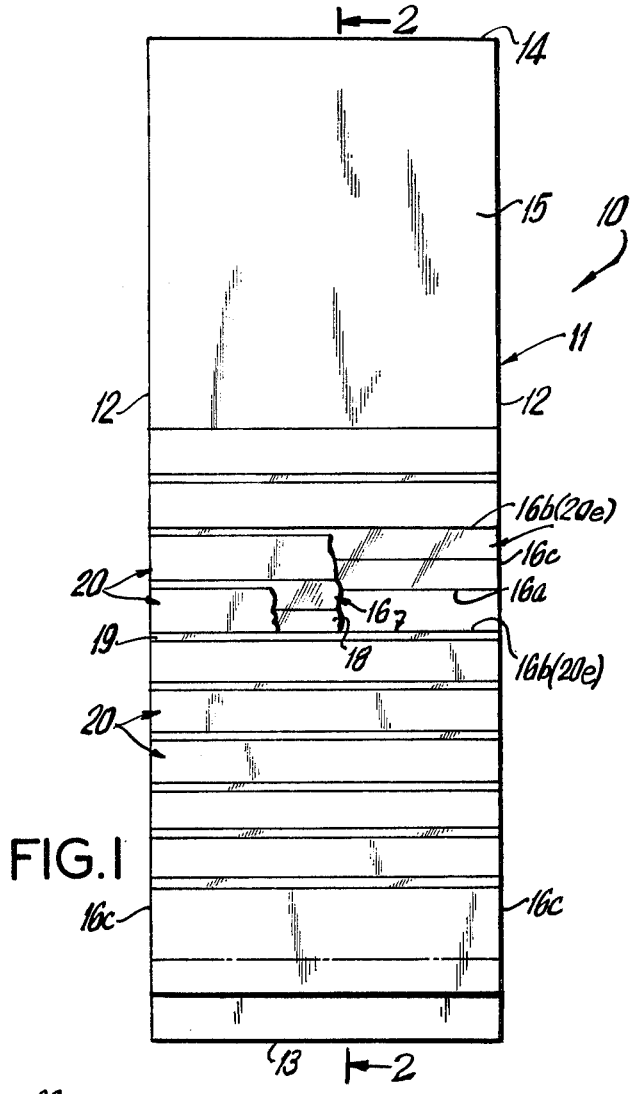
FIG. 1 is a top plan view of a photo album embodying the invention.
Figure 2:
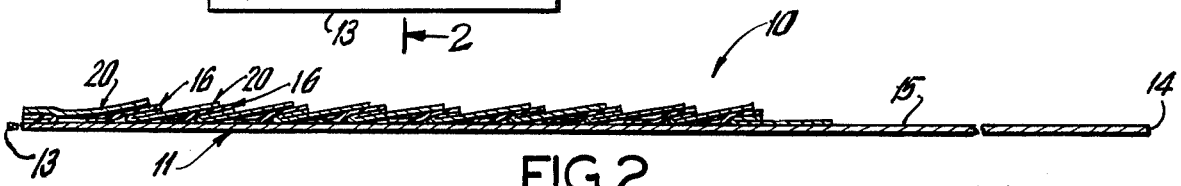
FIG. 2 is a cross-sectional view taken on line 2—2 of FIG. 1.

Referring now in detail to the drawing an particularly to FIGS. 1 and 2 thereof, 10 designates a photographic snapshot album embodying the invention. Said album 10 comprises a backboard or base 11 preferably of elongated rectangular shape, having longer parallel side edges 12, a shorter lower edge 13 and upper edge 14.

Said backboard 11 may comprise cardboard or other suitable stiff or semi-stiff thin material, or paper or backing means.

Attached to the upper surface 15 of said backboard 11 are a plurality of parallel strips 16 of flexible sheets of cloth or paper or plastic film such as Teflon, flourocarbon, polyester, polypropalene. The strips 16 may be clear or colored or opaque and extend transversely of the backboard and are as long as the width of the backboard. Each strip has a lower end edge **16*a*, an upper end edge 16*b* and end edges 16*c* registering with the side edges 12 of the backboard. Strips 16 are of uniform width. The strips 16** may be vacuum plated or printed or may comprise foil, aluminum or lead.

The undersurface of each strip is coated with a coating 17 of pressure sensitive adhesive such as acrylic based adhesive or latex, or acrylate, natural rubber or synthetic resins.

Substantially the lower half or section of each strip 16 is adhered by the pressure sensitive adhesive coating 17 to the upper surface 15 of the backboard. Edge **16*b* of each strip may substantially coincide or register with the edge 16*a* of the next adjacent strip 16, in a direction toward the upper end of the backboard. The area or section of each strip 16 which is adhered to the baseboard is designated in the drawing by numeral 18. The section or portion of the strip 16 which extends from the portion 18 and designated by numeral 19 inclines away from surface 15**.

Attached to each strip 16 is a release ribbon or piece of tape 20 which may be made of paper or other flexible sheet material. Ribbons 20 are of uniform width and extend transversely of the backboard and are coextensive with the strips 16, but of greater width than said strips. Said ribbons may comprise plastic, polyethylene, with or without silicone coating, or parchment with Quilon release or glassine paper with or without silicone. Quilon is an inert coating derived from a chrome complex of chemicals.

Ribbons 20 may each be coated at their undersides **20*a* with a release coating, not shown, but which may comprise silicone. Each ribbon 20 is folded on itself longitudinally to form a narrower section 20*b* folded about a fold edge 20***c*, against a wider section 20*d*. The outer edge 20*e* of section 20*b* registers with edge 16*b* of the strip 16. The section 20*b* of ribbon 20 is adhered to section 19 of strip 16. Section 20*d* of the ribbon 20 overlies the next adjacent strip 16. The extending portions 20*d* of ribbons 20 constitute pull tabs which may be grasped between fingers of the user to pull off the ribbon and expose the adhesive 17 at the underside of portion 19 of the strip 16 to which the ribbon was adhered.

Because of the presence of the release coating at the undersurface of 20*a* of the ribbon, the ribbon can be pulled off the strip while the strip remains adhered and anchored to the backboard 11 by reason of the adhesive coating 17 on section 18 of the strip. If the portion of the area of the ribbon adhered to the strip is less than the area of the strip adhered to the backing member or backboard 11, the release material on the ribbon may be omitted.

It will be noted that the strips 16 and ribbons 20 do not cover the entire surface of the backboard 11. An upper and lower end portion of the backboard is left without strips and ribbons, for the purpose hereinafter appearing.

As shown in FIG. 2, the lowermost strip 16 may be folded over in half with portion 19 thereof overlying portion 18 thereof, and the ribbon 20 attached to portion 19 is substantially flattened out to produce a neat lower end to the album.

Figure 3:
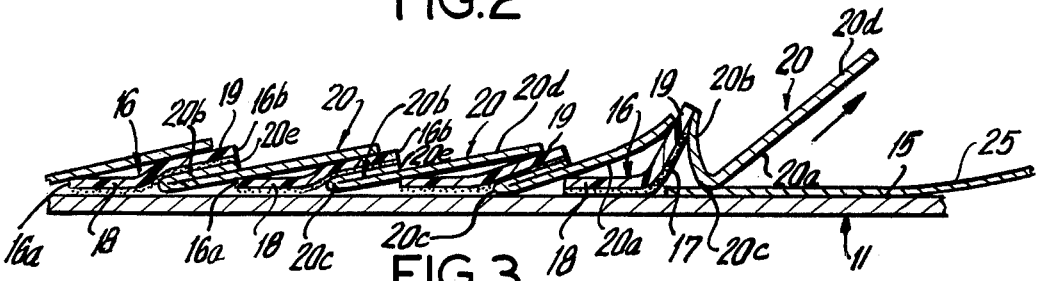
FIG. 3 is a partial enlarged view of the structure of FIG. 2 and showing an end release ribbon partially pulled off an adhesive strip to which it was adhered.
Figure 4:
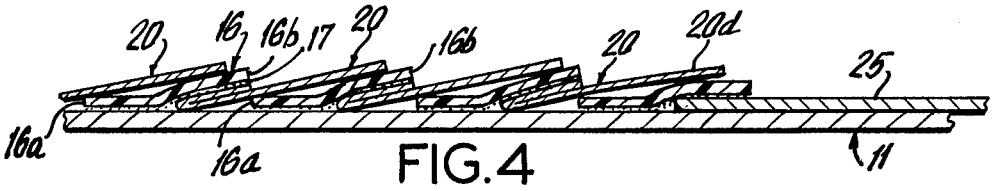
FIG. 4 is a view similar to FIG. 3 but showing a photo snapshot adhered to the portion of the adhesive strip from which the release ribbon of FIG. 3 was pulled off.

In FIG. 3, the uppermost ribbon 20 is shown being pulled off the strip 16 to which it was adhered. After the ribbon is removed, and the adhesive 17 on section 19 is exposed, the lower end portion of a photographic snapshot 25 may be adhered to the exposed adhesive by pressing said lower end portion to said exposed adhesive as shown in FIG. 4. The snapshot 25 then lies flat on the upper blank portion of surface 15 as shown in FIG. 4.

After one snapshot is attached, another snapshot can be attached by thereafter pulling off the ribbon 20 next to the one that was first removed, and pressing the lower edge portion of another snapshot to the exposed adhesive 17 on the section 19 of the next adjacent strip 16. This action can be repeated until all 10 strips 16 have snapshots attached thereto to make a full album.

Figure 5:
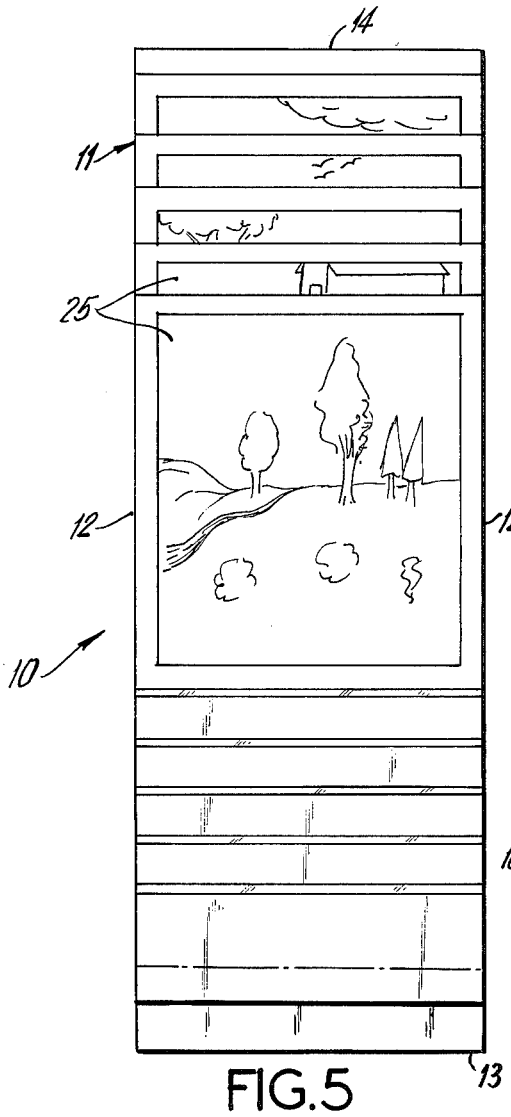
FIG. 5 is a view similar to FIG. 1, but with five photo snapshots attached.
Figure 6:
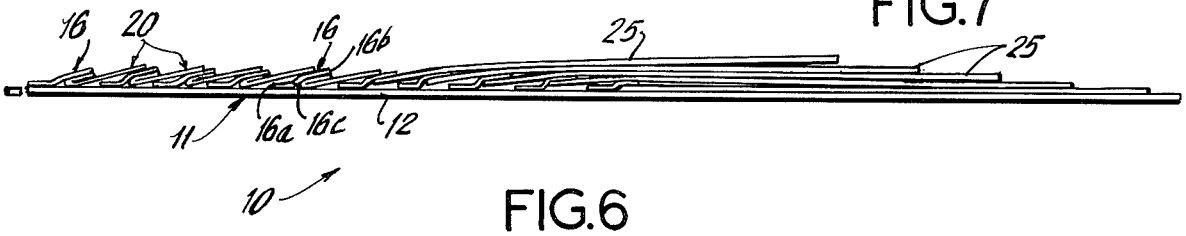
FIG. 6 is a side view of the structure of FIG. 5 looking toward the right edge of the structure of FIG. 5.

In FIGS. 5 and 6, the album is shown with only five snapshots attached.

Figure 8:
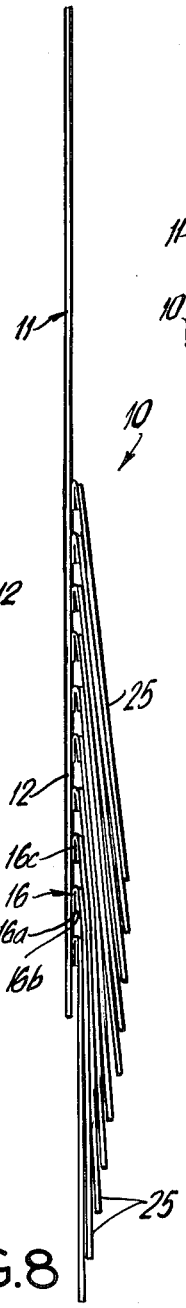
FIG. 8 is a side view of the structure of FIG. 7 looking toward the left edge of the structure of FIG. 7.
Figure 7:
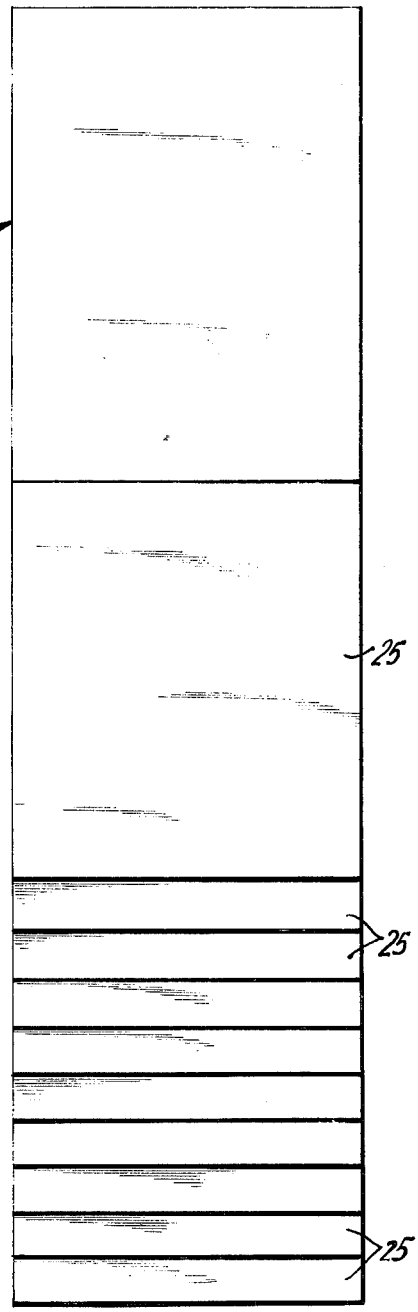
FIG. 7 is a top plan view of an album embodying the invention with all ten snapshots attached and all folded down so that the pictures in the snapshots are hidden.

In FIGS. 7 and 8, all 10 snapshots are attached but the snapshots are folded down so that the pictures on the snapshots are hidden from view.

It will be noted that the adhesive 17 on section 18 of each strip 16 creates a stronger attachment between the strip 16 and the backboard 11 than the attachment of section or portion 20*b* of ribbon 20 to the adhesive 17 on section 19 of the strip.

The reason that this is so, is because the release coating on the attached surface of section 20*b* of said ribbon makes the attachment easier to break. Thus, the ribbon can be readily pulled off the strip 16, while the strip remains securely attached to the backboard.

The clear plastic strips 16 are readily foldable about the folds 16*c* between sections 18 and 19 of the strips and said fold can withstand many foldings and unfoldings without tearing or weakening, because of the nature of the material of which the strips are made.

Figure 9:
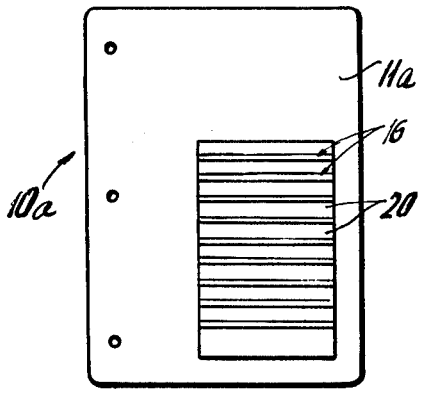
FIG. 9 is a top plan view of a modified form of the invention.

In FIG. 9 there is shown an article 10*a* embodying another form of the invention, in which the backing member or backboard 11 is replaced by a sheet of paper 11*a* which may be a page of a loose leaf notebook. The strips 16 and ribbons 20 may be applied the same way as in FIG. 1 to 8, but only on a portion of the sheet 11*a*.

Figure 10:
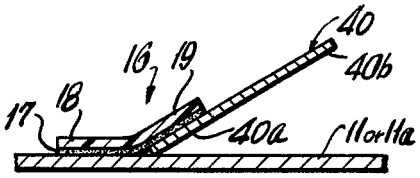
FIG. 10 is a partial cross-sectional view illustrating another modified form of the invention.

In FIG. 10, the backing member 11 or 11*a* has strips 16 adhered to the backing in the same way as they are adhered in FIGS. 1–8. Thus each strip 16 has a portion 18 adhered to the backing member, and a portion 19 swingable away from the backing member and also coated with pressure sensitive adhesive. However in FIG. 10, the ribbon 40 is not folded but has one portion 40*a* adhered to coated portion 19 of strip 16, and an extending portion 40*b* projecting beyond the strip 16 and comprising a pull tab to be grasped to pull the ribbon off the strip and expose the adhesive coated portion 19 of the strip so that a snapshot can be adhered thereto. Thus ribbon 40 is in one plane. The strips and ribbons are repeated as in FIGS. 1 to 8.

Figure 11:
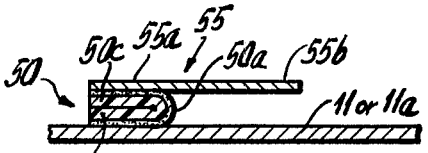
FIG. 11 is a partial cross-sectional view of still another modified form of the invention.

In FIG. 11, the backing 11 or 11*a* has folded strips 50 attached thereto. Each strip 50 is coated on one side with pressure sensitive adhesive and is folded lengthwise about a fold 50*a* to form a bottom section 50*b* adhered to the backing member, and a top section 50*c* folded over said bottom section. A flat ribbon 55 has one portion 55*a* adhered to section 50*c*, and a portion 55*b* extending beyond the fold 50*b* to constitute a pull tab for pulling the ribbon 55 off the strip 50. The portions of ribbons 40 and 55 adhered to the strips 16, 50, respectively, may be coated with release material or the sections of the ribbons adhered to the strips may be of smaller area than the portions of the strips adhered to the backing member, whereby to permit the ribbons to be peeled off readily and without pulling the strips off the backing member.

It will thus be seen that there is provided a device in which the several objects of this invention are achieved and which is well adapted to meet the conditions of practical use.

As various possible embodiments might be made of the above invention, and as various changes might be made in the embodiment above set forth, it is to be understood that all matter herein set forth or shown in the accompanying drawings is to be interpreted as illustrative.

If desired, the extensions 20*d*, 40*b* and 55*b* of ribbons 20, 40, 55, respectively, could be omitted and the ribbons in such case could be peeled off.

I claim:

1. An album comprising a backing member, a plurality of similar, parallel flexible elongated strips, said strips each having a first longitudinal section attached to a surface of said backing member by means of pressure sensitive adhesive coating on said first section of said strip, each strip having a second pressure sensitive adhesive coated section extending from the first adhesive coated section of said strip and swingable away from said backing member, and a plurality of elongated ribbons of sheet material, adjacent said strips, there being one ribbon associated with each strip, respectively, each strip extending to one side of said ribbon associated therewith, in a direction toward the upper end of the backing member, each ribbon having a first section adhered only to the second adhesive coated section of the strip associated with said ribbon, and a second section extending from the first section of said ribbon, beyond the strip to which it is adhered, said second section of each of said ribbons being uncoated with adhesive and providing a pull tab which may be grasped by the user to facilitate pulling the ribbon off the second adhesive coated section of said strip, to which it is adhered, the attachment of said ribbons to said strips being less resistant to detachment of said ribbons from the strips than to detachment of said strips from the backing member, whereby said ribbons can be pulled off said strips without pulling the strip off the backing member, and to uncover the adhesive coated second section of the strip associated therewith, so that a photographic snapshot can be attached to said uncovered coated second section of said strip, by pressing a portion of the snapshot against said uncovered adhesive coating of the second section of said strip, the second section of each ribbon overlapping the strip next adjacent to the strip associated with the ribbon but located on the other side of said ribbon in a direction toward the lower end of said backing member, but not extending therebeyond.

2. The combination of claim 1, the surface of portion of the ribbon adhered to said second section of said strip being coated with a release coating to facilitate pulling the ribbon off the strip without detaching the strip from the backing member.

3. The combination of claim 1, said strips comprising flexible sheeting.

4. The combination of claim 1, said ribbons comprising flexible sheeting.

5. The combination of claim 1, said strips and ribbons each being of uniform width throughout their lengths.

6. The combination of claim 1, the opposite longitudinal edges of said strips substantially registering with adjacent edges of adjacent ribbons, respectively.

7. The combination of claim 1, said first and second coated sections of said strips being of uniform, substantially similar width throughout.

8. The combination of claim 1, the first and second sections of said ribbons being of uniform width throughout, the second section of each ribbon being wider than the first section of the ribbon and extending beyond the first section of said ribbon and beyond the second section of said strip.

9. The combination of claim 1, said second section of each of said ribbons extending transversely beyond the first section of said ribbon, and beyond said strip.

10. The combination of claim 9, said ribbons comprising flexible sheet material.

11. The combination of claim 10, said strips being of uniform width throughout their length and said ribbons each being of uniform width throughout their lengths.

12. The combination of claim 11, the opposite longitudinal edges of said strips substantially registering with adjacent edges of adjacent ribbons, respectively.

13. The combination of claim 12, said first coated sections of said strips being of uniform substantially similar width throughout and said second coated sections of said strips being of uniform, substantially similar width throughout, each of the first sections of said ribbons being of substantially similar width throughout and each of said second sections of said ribbons being of uniform width throughout, the second section of each ribbon being wider than the first section of said ribbon and extending transversely beyond the second section of said strip.

14. The combination of claim 1, said second sections of said ribbons extending transversely beyond said strips, said strips and ribbons covering less than the entire length of the backing member, leaving a portion of the backing member to be covered by a snapshot attached to the uppermost strip on said backing member.

15. The combination of claim 1, said ribbons being wider than said strips.

16. The combination of claim 1, each of said ribbons having a pull tab which is uncoated with adhesive and can be grasped by the fingers of the user to facilitate pulling the ribbon off the strip to which it is attached, each pull tab overlapping the strip next adjacent thereto in a direction toward the lower end of said backing member, but not extending therebeyond.

17. The combination of claim 1, and said second section of said ribbon being folded against the first section of said ribbon.

18. The combination of claim 1, said second section of each strip being folded over the first section of said strip.

19. The combination of claim 1, said second section of said strip extending longitudinally of the first longitudinal section of said strip.

20. The combination of claim 19, said second section of said strip being coextensive with said first section of said strip.

* * * * *

UNITED STATES PATENT AND TRADEMARK OFFICE

CERTIFICATE OF CORRECTION

PATENT NO. : 4,106,230

DATED : August 15, 1978

INVENTOR(S) : Eugene E. Martinez

It is certified that error appears in the above-identified patent and that said Letters Patent are hereby corrected as shown below:

Change name of Assignee from "Robert H. Reikel" to --Robert H. Reibel, part interest --.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,106,230

DATED : August 15, 1978

INVENTOR(S) : Eugene E. Martinez

It is certified that error appears in the above-identified patent and that said Letters Patent are hereby corrected as shown below:

Change the address of the Assignee Robert H. Reibel from "Irvington-on-Hudson, NY" to --Croton-on-Hudson, NY--.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*